US007722028B2

(12) United States Patent
Bitner

(10) Patent No.: US 7,722,028 B2
(45) Date of Patent: May 25, 2010

(54) FEEDER SEPARATION TECHNOLOGY

(76) Inventor: Robert J. Bitner, 6341 Everst La., Maple Grove, MN (US) 55311

( * ) Notice: Subject to any disclaimer, the term of this patent is extended or adjusted under 35 U.S.C. 154(b) by 353 days.

(21) Appl. No.: 11/497,979

(22) Filed: Aug. 2, 2006

(65) Prior Publication Data

US 2007/0138734 A1 Jun. 21, 2007

Related U.S. Application Data

(60) Provisional application No. 60/704,929, filed on Aug. 2, 2005.

(51) Int. Cl.
*B65H 3/04* (2006.01)
*B65H 3/52* (2006.01)

(52) U.S. Cl. ..... 271/35; 271/124; 271/138

(58) Field of Classification Search ..... 271/35, 271/104, 121, 124, 137, 138
See application file for complete search history.

(56) References Cited

U.S. PATENT DOCUMENTS

| | | | | |
|---|---|---|---|---|
| 2,635,874 | A * | 4/1953 | La Bore | 271/35 |
| 3,612,511 | A * | 10/1971 | Godlewski | 271/35 |
| 5,244,198 | A * | 9/1993 | Green | 271/125 |
| 5,601,282 | A * | 2/1997 | Milo et al. | 271/35 |
| 5,642,877 | A * | 7/1997 | Green | 271/35 |
| 5,772,199 | A * | 6/1998 | Green | 271/10.06 |
| 6,412,770 | B1 * | 7/2002 | Demmeler | 271/94 |
| 6,485,012 | B1 * | 11/2002 | Bakoledis | 271/35 |
| 6,929,259 | B2 * | 8/2005 | Abe et al. | 271/121 |
| 6,932,338 | B1 * | 8/2005 | Popejoy et al. | 271/122 |
| 6,978,993 | B2 * | 12/2005 | Hurd | 271/35 |

* cited by examiner

*Primary Examiner*—David H Bollinger
(74) *Attorney, Agent, or Firm*—Skinner & Associates

(57) ABSTRACT

A bottom friction feeder comprises a material magazine assembly, a gate assembly including a guide subassembly and a singulation gate subassembly, a back wedge assembly, and a bottom friction belt assembly.

9 Claims, 17 Drawing Sheets

FEEDER SEPARATION TECHNOLOGY

CROSS-REFERENCE TO RELATED APPLICATIONS, IF ANY

The present application is a formalization of previously filed, U.S. Provisional Patent Application Ser. No. 60/704,929, filed Aug. 2, 2005 by the inventor named in the present application. This patent application claims the benefit of the filing date of the cited Provisional Patent Application according to the statute and rules governing provisional patent applications, particularly 35 USC s. 119(e)(1) and 37 CFR s. 1.78(a)(4) and (a)(5). The Specification and Drawings of the cited Provisional Patent Application are specifically incorporated herein by reference.

37 C.F.R. §1.71(e) AUTHORIZATION

A portion of the disclosure of this patent document contains material which is subject to copyright protection. The copyright owner has no objection to the facsimile reproduction by anyone of the patent document or the patent disclosure, as it appears in the US Patent and Trademark Office patent file or records, but otherwise reserves all copyright rights whatsoever.

Statement Regarding Federally Sponsored Research or Development

Not applicable.

Reference to a Microfiche Appendix, If Any

Not applicable.

BACKGROUND OF THE INVENTION

1. Field of the Invention

The present invention relates, generally, to automated materials handling machinery. Particularly, the invention relates to automated machinery for feeding material into a related machine or system. Most particularly, the invention relates to friction feeder machinery.

2. Background Information

Bottom Friction Feeders are used throughout the graphics, mailing and packaging industries. They are used to feed product from a stack. Bottom Friction Feeder technology is utilized by a number of companies.

The existing technology includes that disclosed in U.S. Pat. Nos. 5,967,507, 5,476,255 and 5,255,905. These patents relate to top sheet feeders.

A need exists for the present invention.

All US patents and patent applications, and all other published documents mentioned anywhere in this application are incorporated by reference in their entirety.

BRIEF SUMMARY OF THE INVENTION

Bottom Friction Feeder technology typically utilizes a separation gate system with height adjustment that allows for one product to be fed between the Gate Assembly and the feed belts. Reliably feeding various products on a bottom friction feeder requires that the friction between the feed belts and the bottom product must be greater than between the bottom product and the stack above it. It also requires the separation gate device to overcome the friction between two products to reliably retain the stack of product while a single product is fed. Typical separation gates incorporate some type of high friction (for example, urethane) retaining rings that assist in separation of product. This traditional method is useful for certain types of products, but many products cannot feed consistently. This is due to two main reasons; the first is a high coefficient of friction between two products and the second is a stability of the product (i.e., thin or flexible product) being fed.

The separation gate design of the present invention overcomes the limitations of bottom friction feeders. It has two adjustable assemblies. The first is an adjustable guide that forms the bottom product into a corrugated shape that both stiffens flexible product and reduces the surface tension between two products. The second assembly is a urethane ring(s) or friction wheel that adjusts to assist in retaining product. The result of this is a Bottom Friction Feeder that can handle a wider range of product that is more reliable.

One aspect of the invention provides a bottom friction feeder comprising a material magazine assembly, a gate assembly including a guide subassembly portion and a singulation gate subassembly portion, a back wedge assembly, and a bottom friction belt assembly.

Another aspect of the invention provides a gate assembly for a bottom friction feeder comprising a guide assembly and a singulation gate assembly.

The features, benefits and objects of the invention will become clear to those skilled in the aft by reference to the following description, claims and drawings.

DETAILED DESCRIPTION

The preferred embodiment of the bottom feeder system of the present invention comprises several major assemblies, namely a material magazine assembly, a gate assembly, a back wedge assembly and a bottom friction belt assembly.

The items to be fed may be labels, package inserts, product instructions, or other thin, generally flat items of paper or polymer. For sake of simplicity, the products being fed will be referred to herein as labels, keeping in mind the other types of items that may be used. The present invention is a component of a larger packaging system that is known in the art. Thus, the description will focus on the label feeder section, assuming those skilled in the art will understand the use and application of such a feeder in a larger system.

Figure 1:
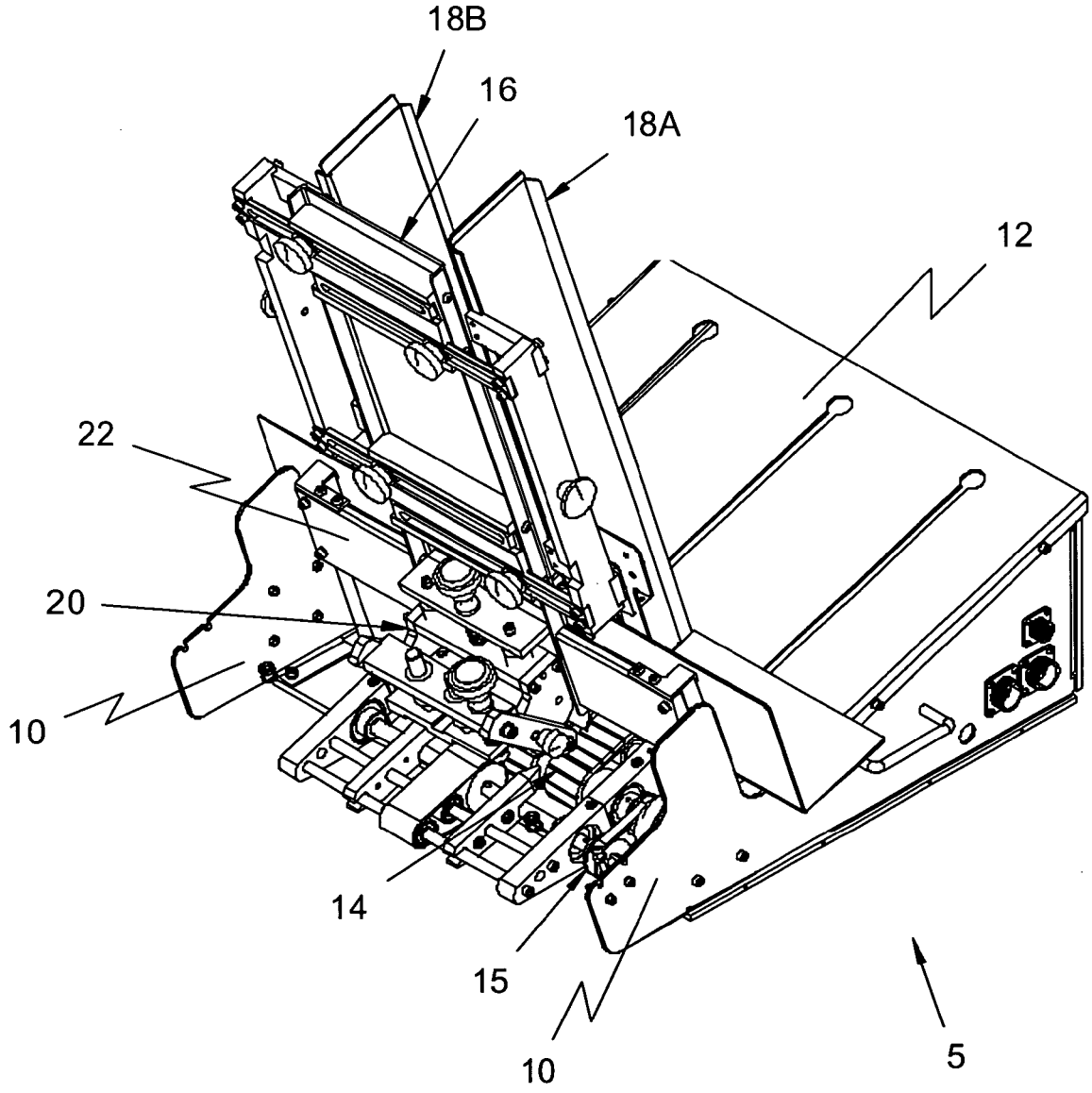
FIG. 1 is a perspective view of an embodiment of the feeder system of the present invention, including an embodiment of a frame, carriage and gates.

FIG. 1 illustrates a feeder 5 of the present invention as it might appear prior to integration into a larger system. Side frames 10 are connected to a product table 12 to form a rigid structure. A series of driven belts 14, preferably made of a high friction material; extend outward from the product table 12 and below the product table 12. The belts 14 are supported from side rails 28A-B (see FIG. 3).

The side rails 28A-B also support a drive 15 for the belts 14. Extending upward from the frame 10 is a product magazine 16. The product magazine 16 has extending vertical rails 18A-B which are adjustable to accommodate various sizes of products to be fed by the feeder 5. The product to be fed, labels in the present example, are stacked in a vertical array between the side rails 18A-B. A gate assembly 20, attached to a cross member 22 which is in turn attached to the side frames 10, then feeds labels one at a time from the bottom of the stack of labels in the product magazine 16.

Figure 2:
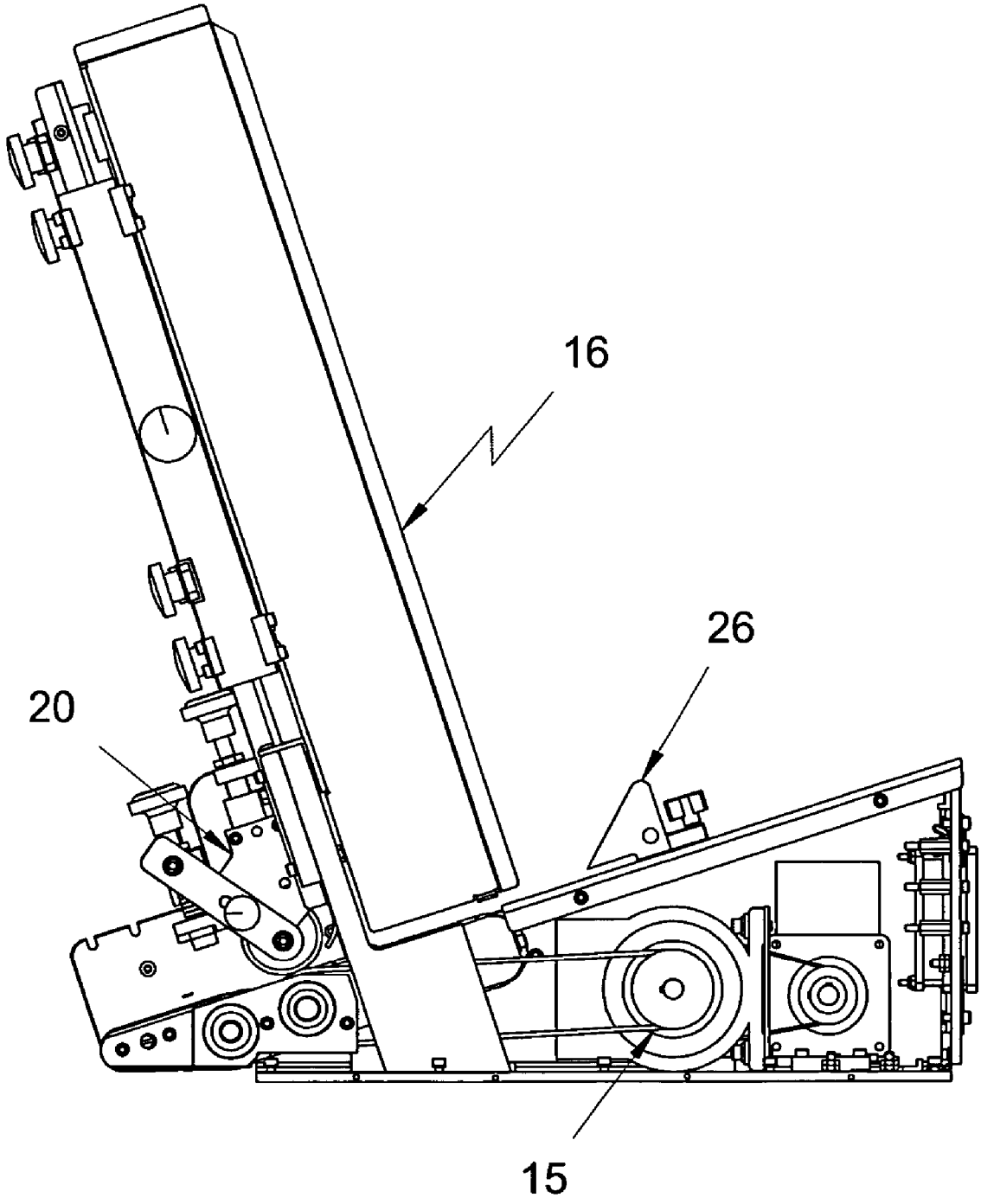
FIG. 2 is a side view of the feeder system.

In FIG. 2, one of the side frames 10 has been removed as has one of the vertical rails 18A. The drive 15 for the belts 14 is more visible in the figure. In addition, a movable back wedge assembly 26 is visible. The back wedge assembly elevates the back edge of a stack of labels in the product magazine 16 and helps control the movement of the labels in the product magazine 16. FIG. 2 also shows more clearly the gate assembly 20.

Figure 3:
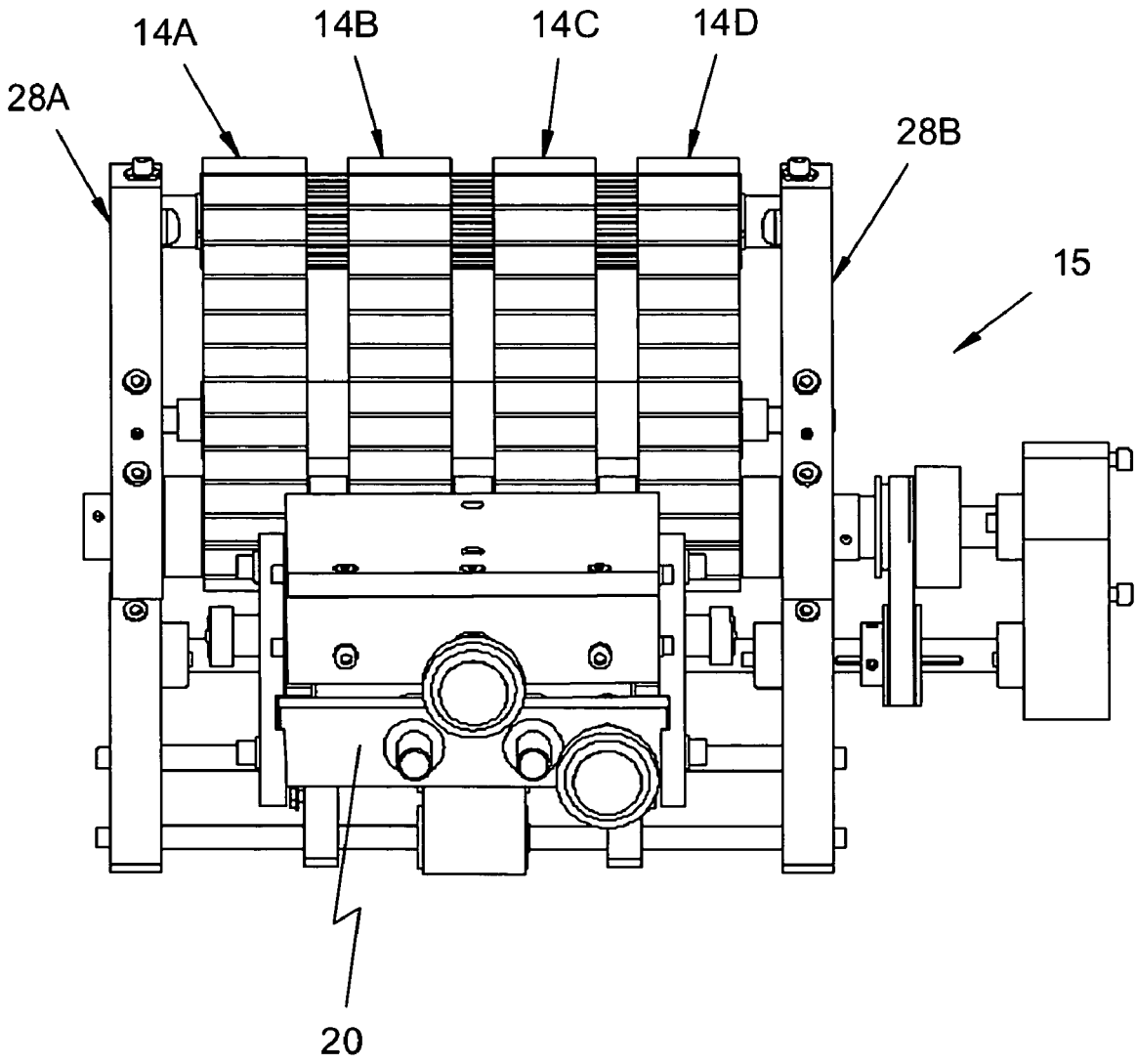
FIG. 3 is a top or plan view of the carriage and gate assemblies of the feeder system.

FIG. 3 shows a top view of the gate assembly 20 and the drive 15 removed from the overall feeder 5. This shows that in this embodiment there are four feed belts 14A-D. The drive belts 14A-D are mounted to the side rails 28A-B, as is the drive 15. In normal use, the side rails 28A-B would be secured to the feeder 5, generally to the side frames 10.

Figure 4:
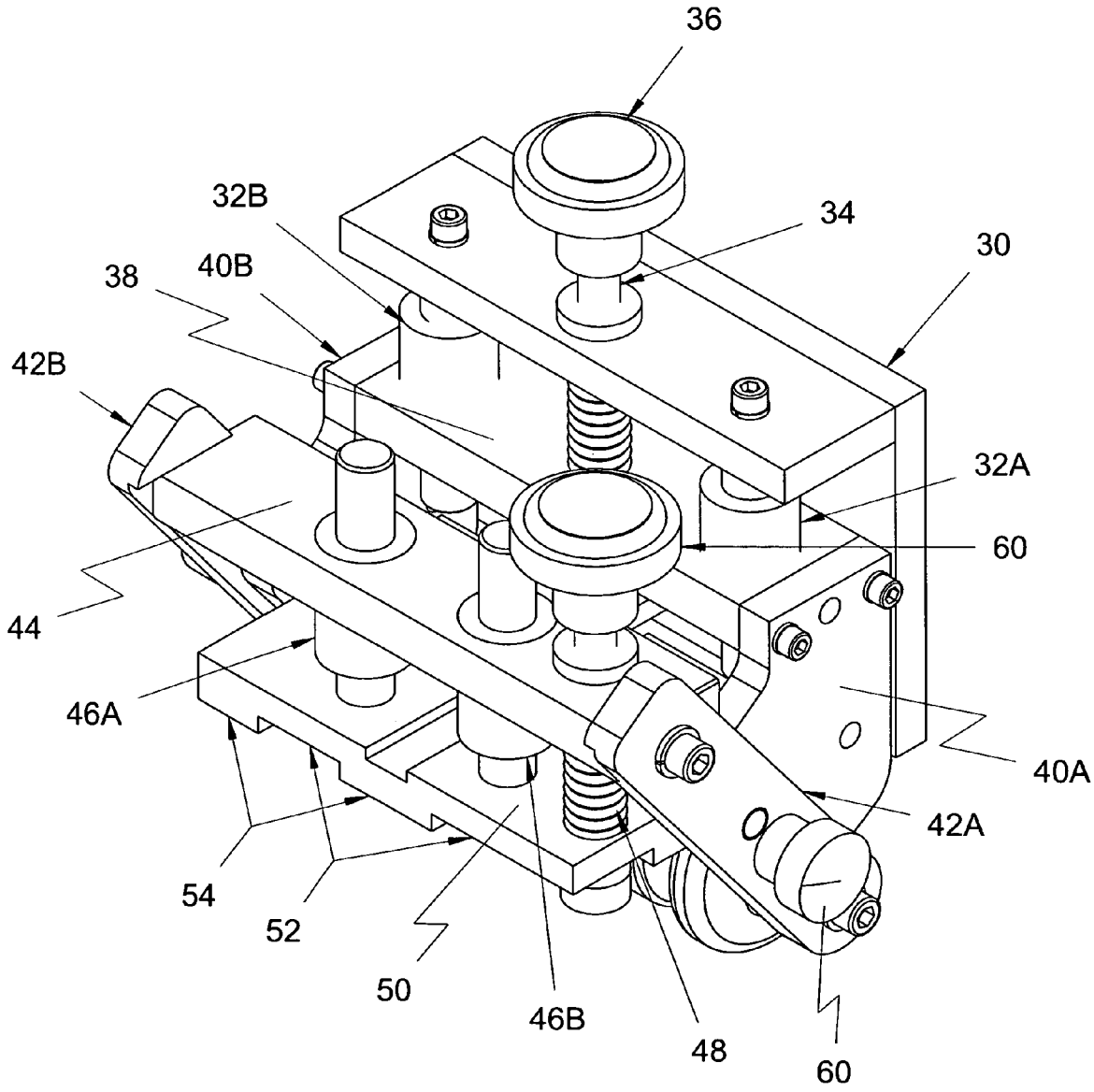
FIG. 4 is a top perspective view of embodiments of guide and singulation portions of the present invention.
Figure 5:
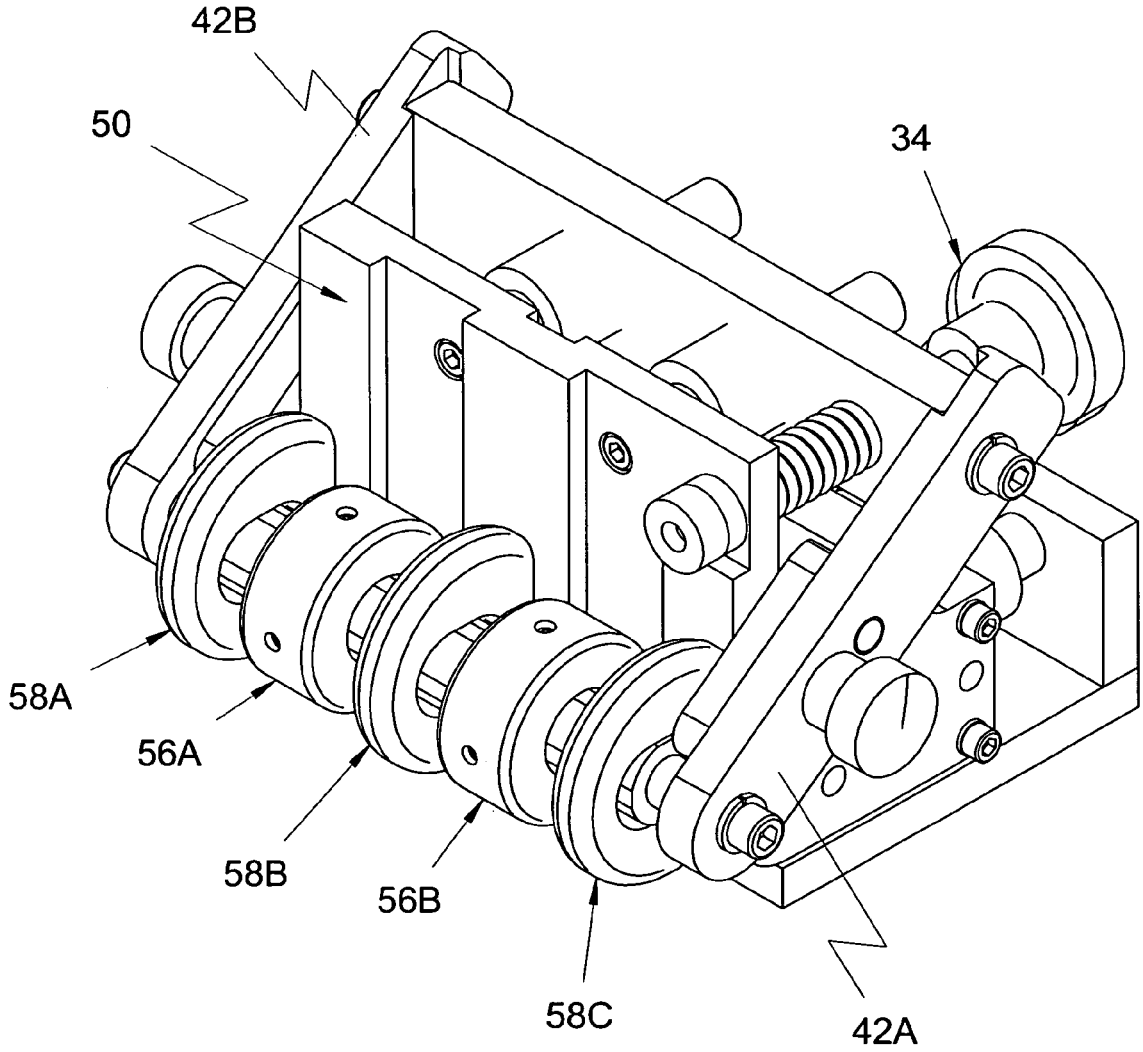
FIG. 5 is a bottom perspective view of the embodiment of the guide and singulation portions shown in FIG. 4.

FIGS. 4 and 5 illustrate the two major sections of the gate assembly 20 and its construction. An L shaped bracket 30 supports two linear bearings 32A-B and a jack screw 34. A knob 36 of the jack screw 34 allows vertical movement of a support plate 38 to which the jack screw 34 is attached. In operation, the bracket 30 would normally be fixed in place to the cross member 22. Attached to the support plate 38 are side plates 40A-B. Movement of the jack screw 34 will raise or lower the support plate 38 and side plates 40A-B. Attached to the side plates 40A-B are adjustment arms 42A-B. The adjustment arms 42A-B are in turn connected to a bearing plate 44. The bearing plate 44 is connected by linear bearings 46A-B and a second jack screw 48 to an adjustment plate 50. As best seen in FIG. 5, the lower portion of the adjustment plate 50 has grooves 52 and lands 54 formed therein. The grooves 52 are positioned to clear two friction feed wheels 56A-B and the lands 54 are positioned to contact flat portions (see FIG. 6) of deflector wheels 56A-C. The wheels 56A-B and 58A-C are carried on a common shaft (see FIG. 6). An adjustment knob 60 mounted on the adjustment arms 42A-B allows the position of the deflection wheels 58A-C to be adjusted. The jack screw 48 allows vertical adjustment of the adjustment plate 50 relative to the bearing plate 44.

Figure 6:
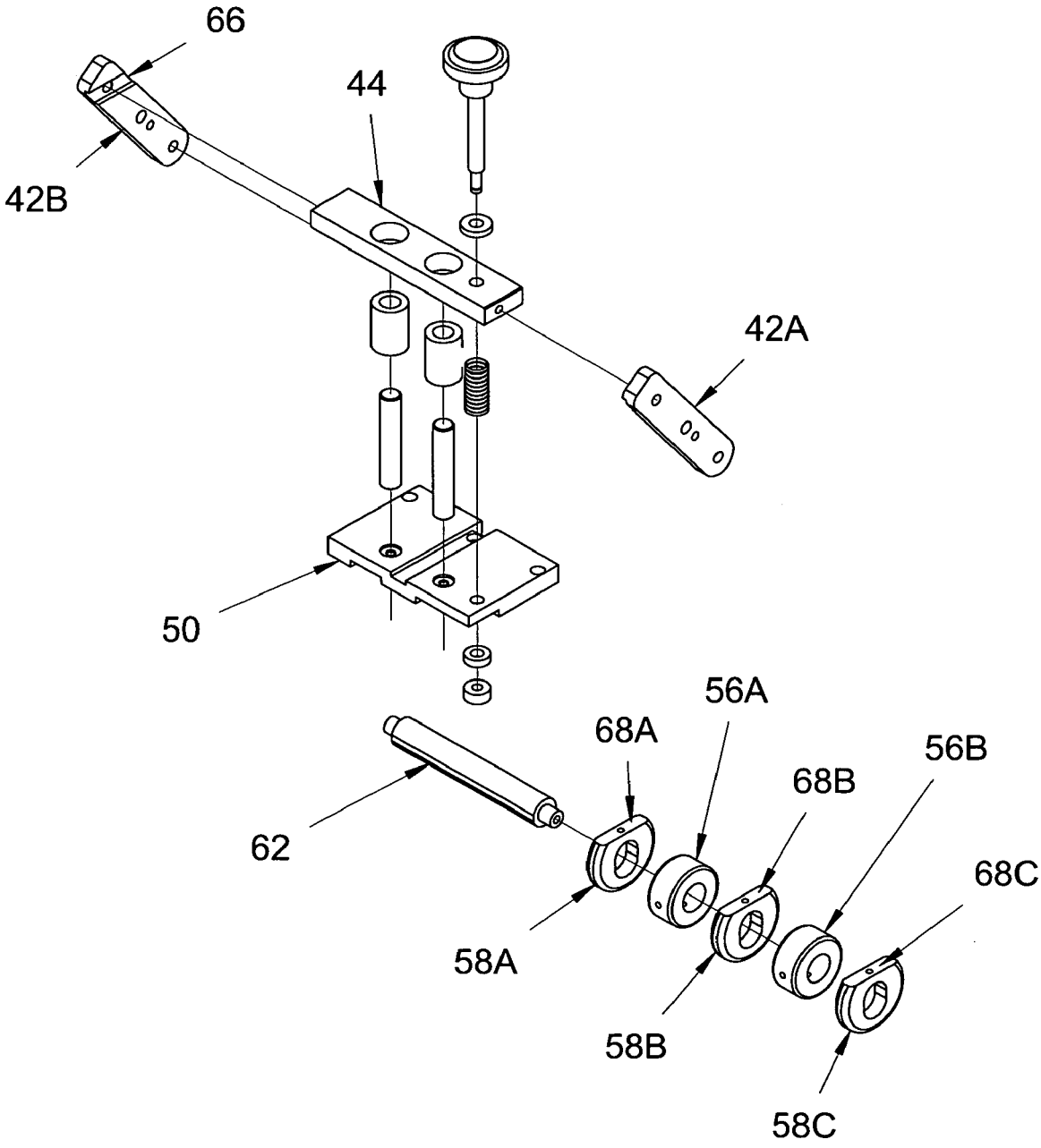
FIG. 6 is an exploded view of embodiments of certain components of the guide and singulation assembly.
Figure 7:
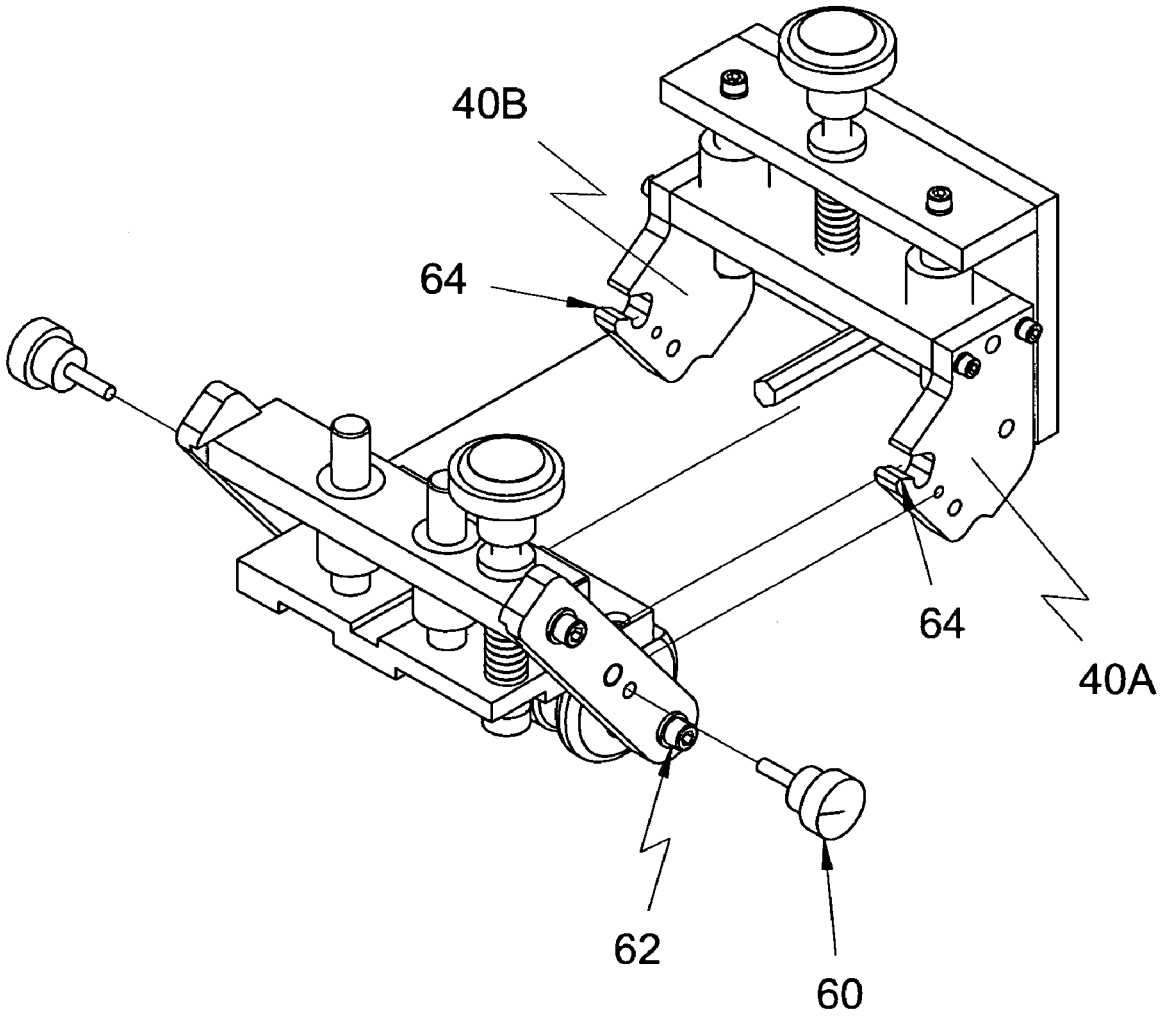
FIG. 7 an exploded view of the guide and singulation assemblies.

The exploded view of FIG. 6 shows a shaft 62 upon which the wheels 56A-B and 58A-C are mounted. Neither set of wheels actually rotates on the shaft 62, but performs in a manner to be explained. The shaft 62 is then mounted on the adjustment arms 42A-B. For the sake of clarity, some components such as nuts, bolts, pins and washers have been omitted from FIG. 6. The adjustment arms 42A-B carrying the wheels 56A-B and 58A-C are then attached to the bearing plate 44 and adjustment plate 50. Finally, as seen in FIG. 7, this subassembly is connected to slots 64 in the side plates 40A-B. Note in FIG. 6 that the adjustment arms 42A-B have angled slots 66 formed in their surface facing the bearing plate 44 and sized to fit onto the bearing plate 44. Only one slot 66 in the arm 42B is visible in FIG. 6 but there is a corresponding slot 66 in the arm 42B. The deflector wheels 58A-C all have flats 68A-C formed on their top surface. The flats 68A-C cooperate with and contact the lands 54 formed on the adjustment plate 50. It can now be seen that assembling the two subassemblies shown in FIG. 7 will result in the gate assembly 20 shown in FIG. 4.

Figure 8:
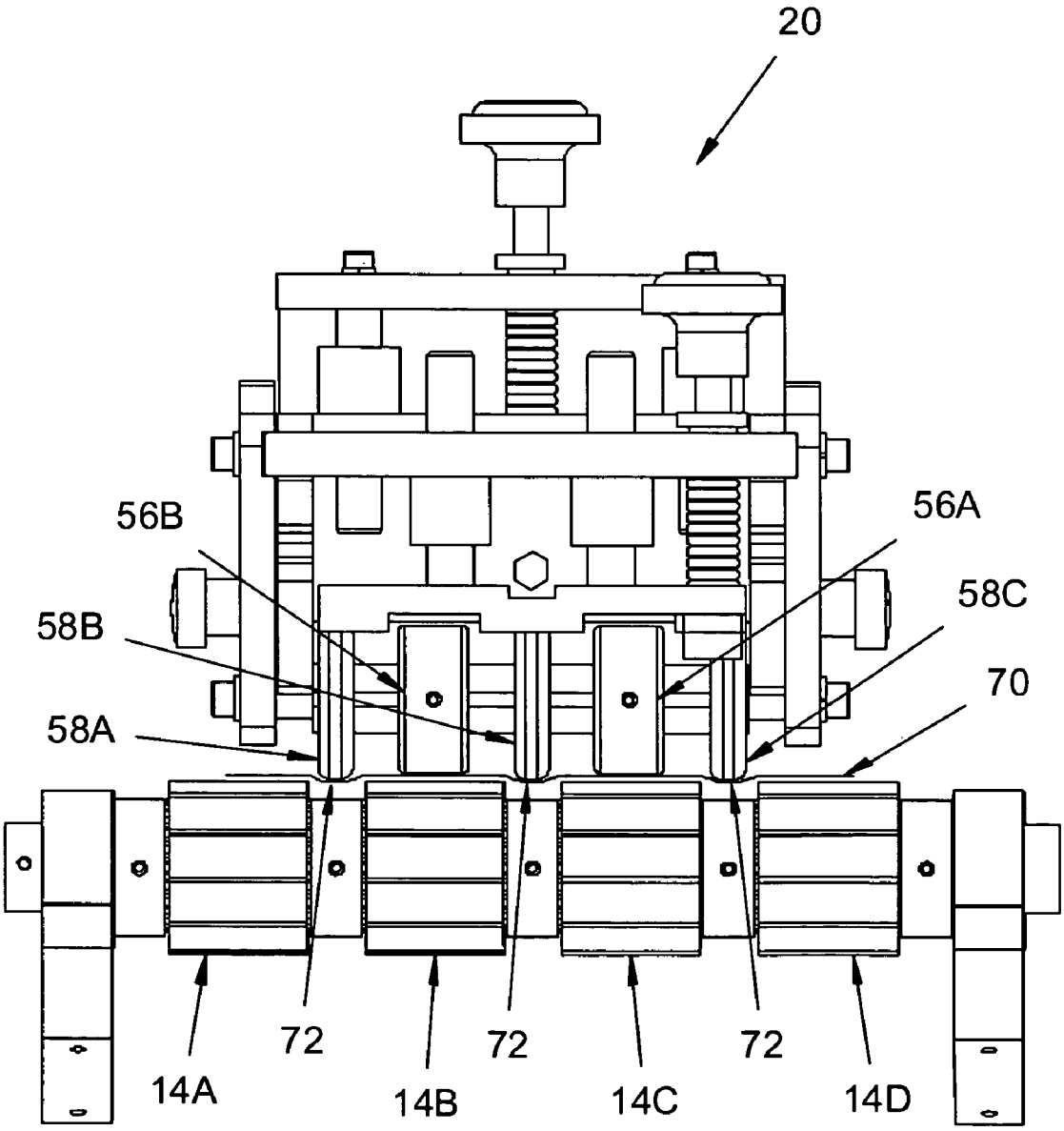
FIG. 8 is a front view of the guide, singulation, and belt assemblies of the present invention.
Figure 9:
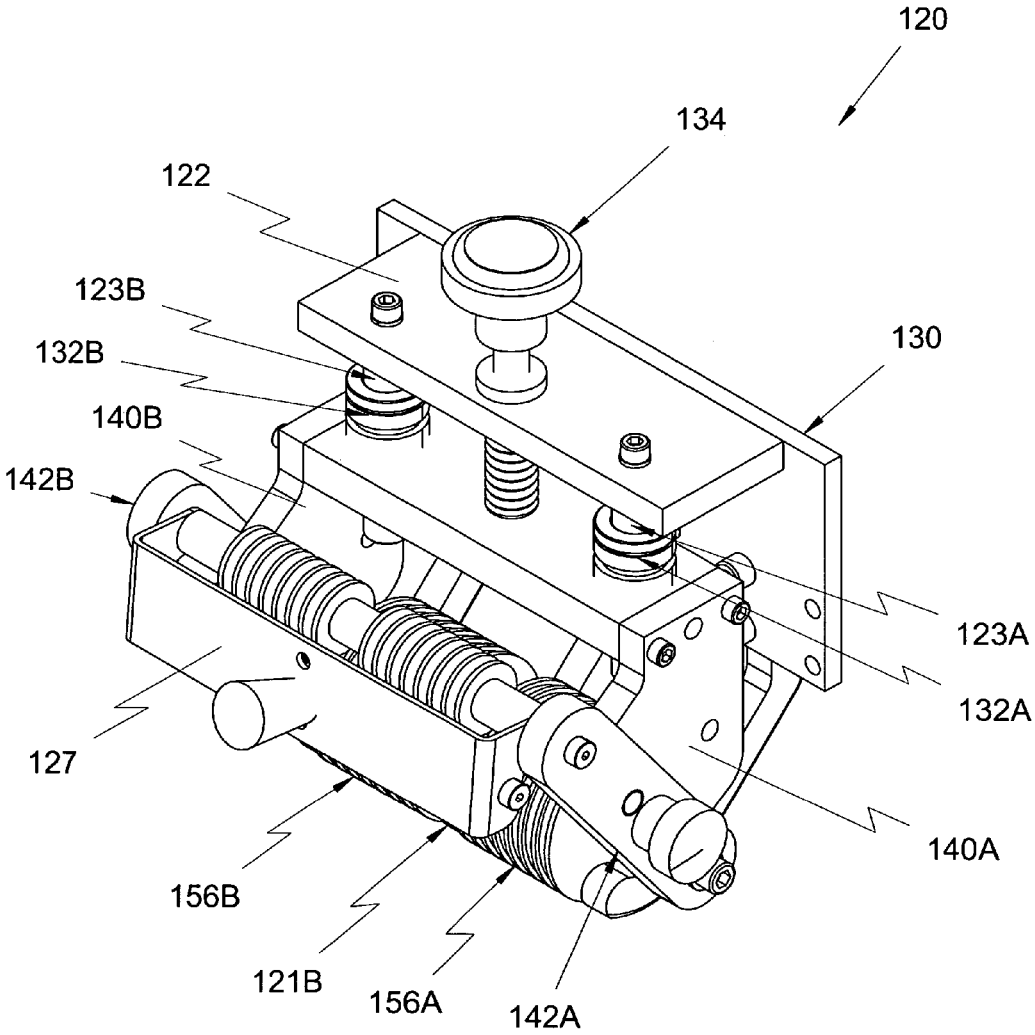
FIG. 9 is a front perspective view of an alternative embodiment of guide and singulation assemblies of the invention.
Figure 10:
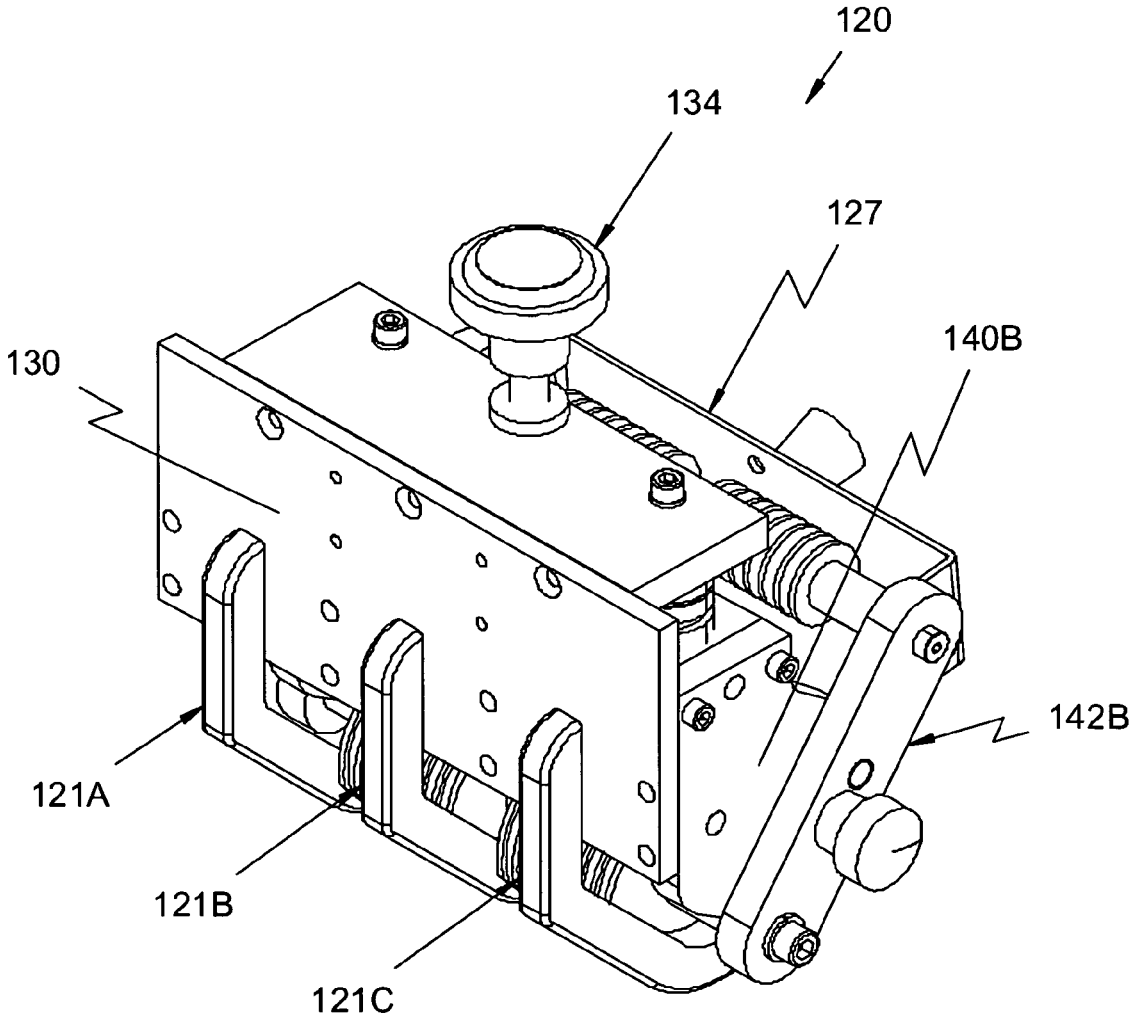
FIG. 10 is back, opposite side perspective view of the assemblies of FIG. 9.
Figure 11:
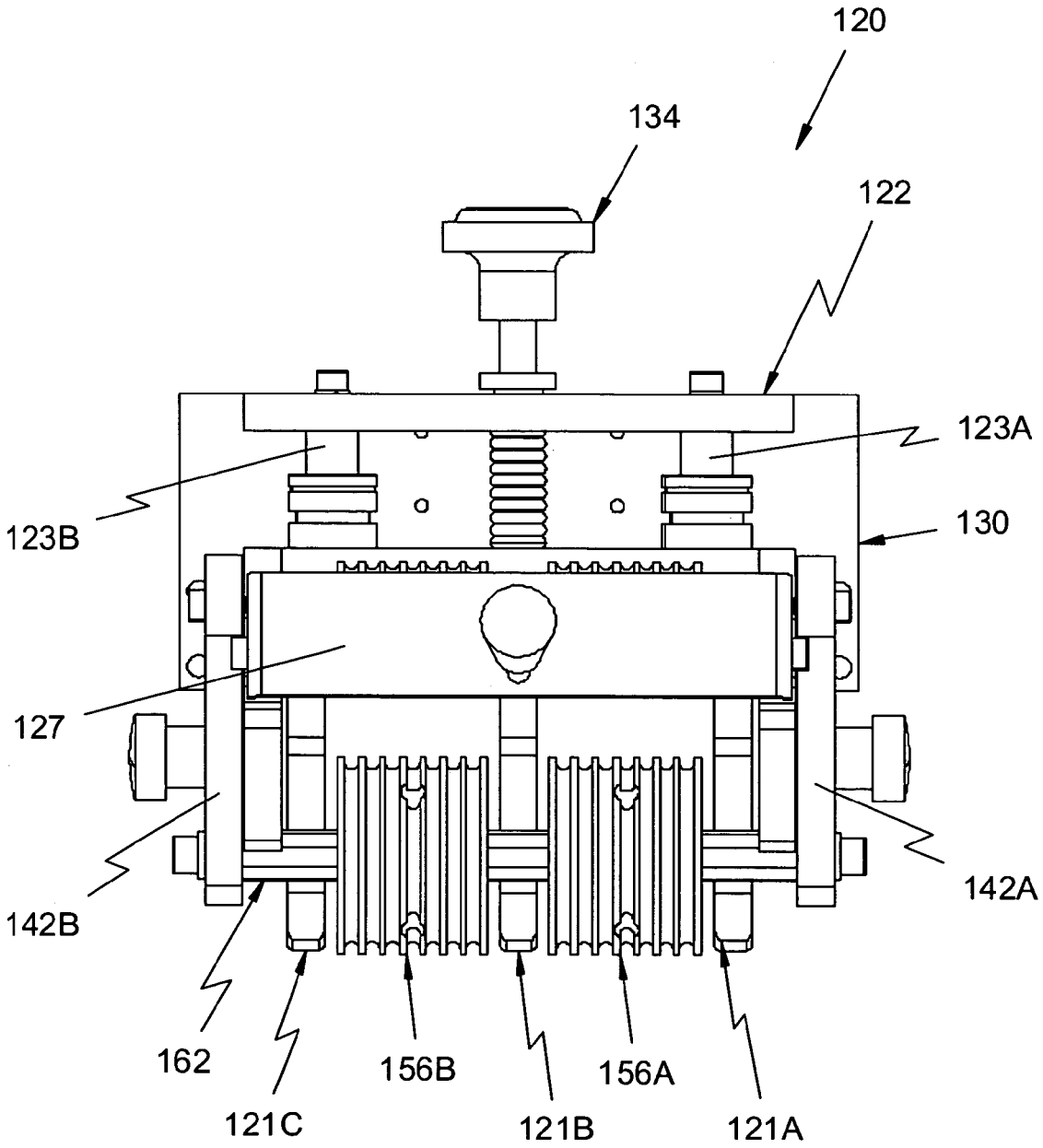
FIG. 11 is a front view of the assemblies.
Figure 12:
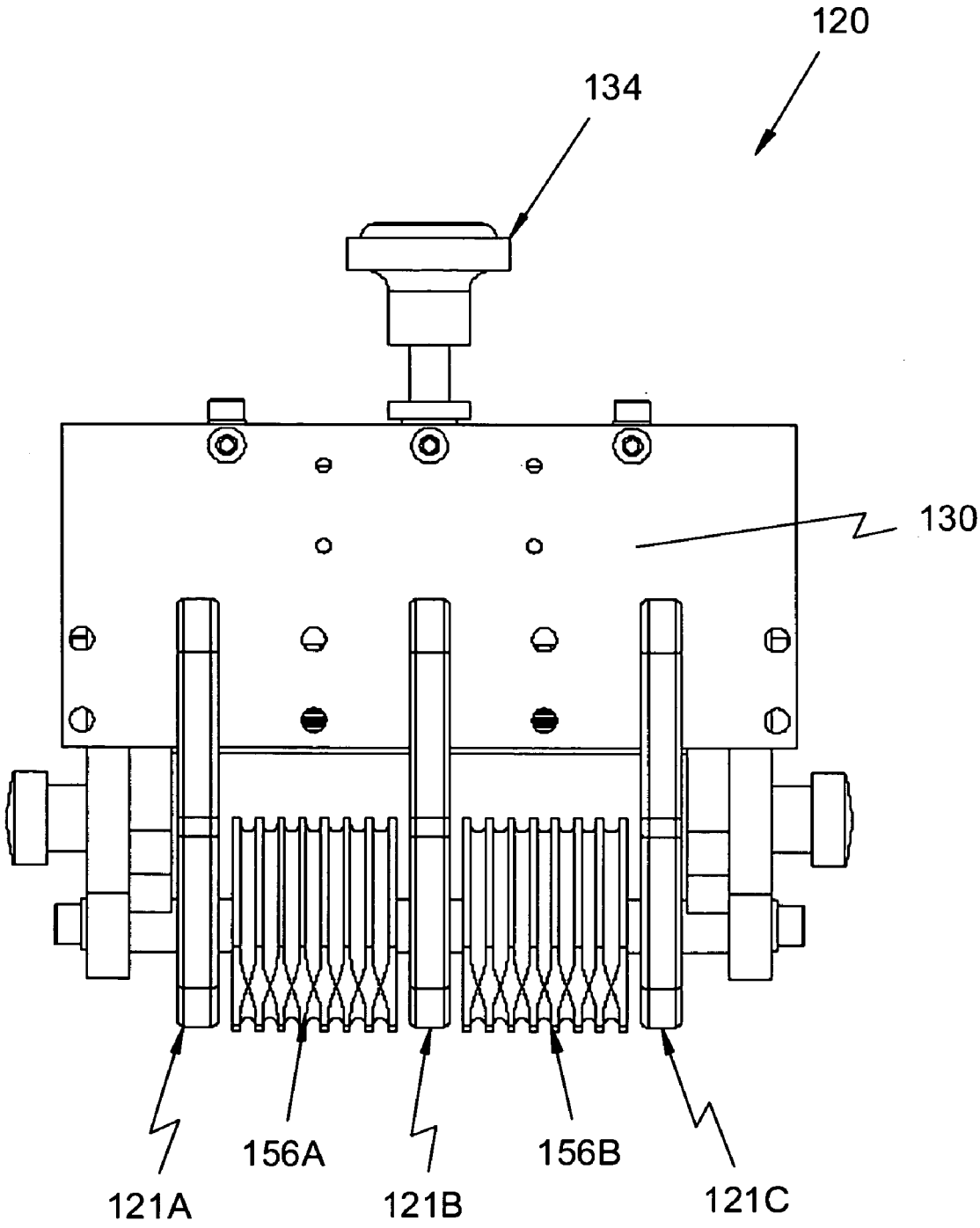
FIG. 12 is a back view of the assemblies.
Figure 13:
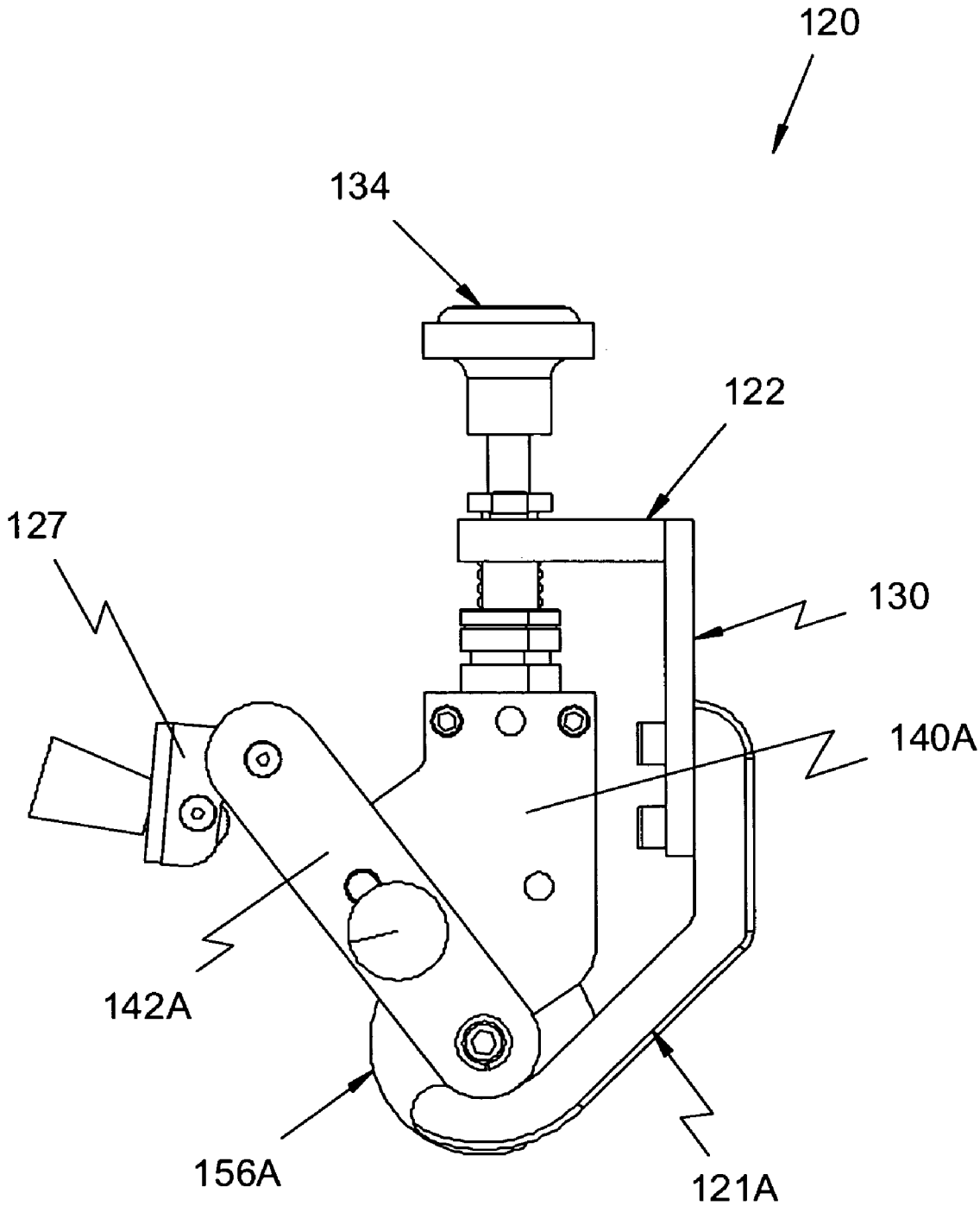
FIG. 13 is a side view of the assemblies, the opposite side being substantially similar thereto.
Figure 14:
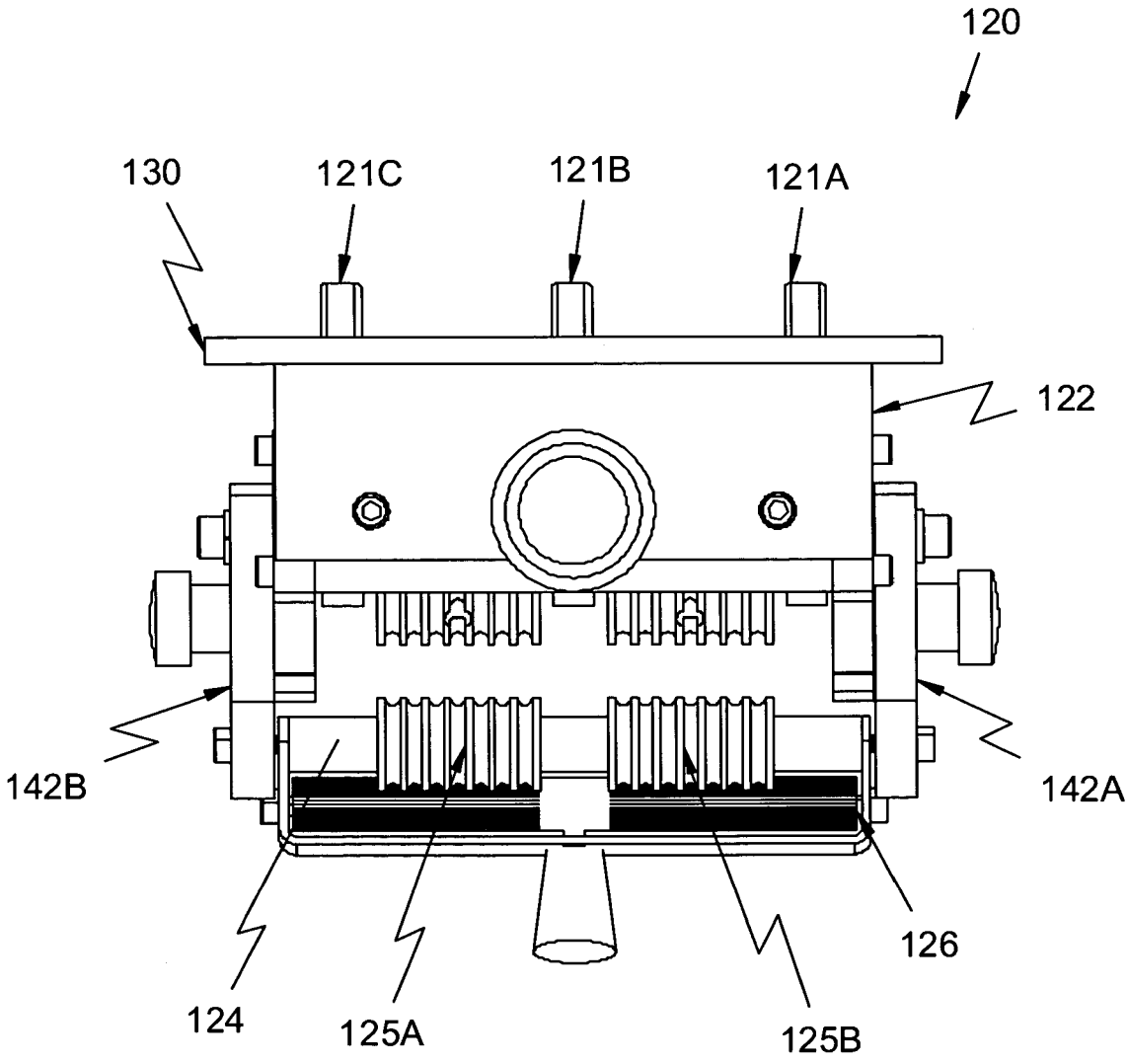
FIG. 14 is a top or plan view of the assemblies.
Figure 15:
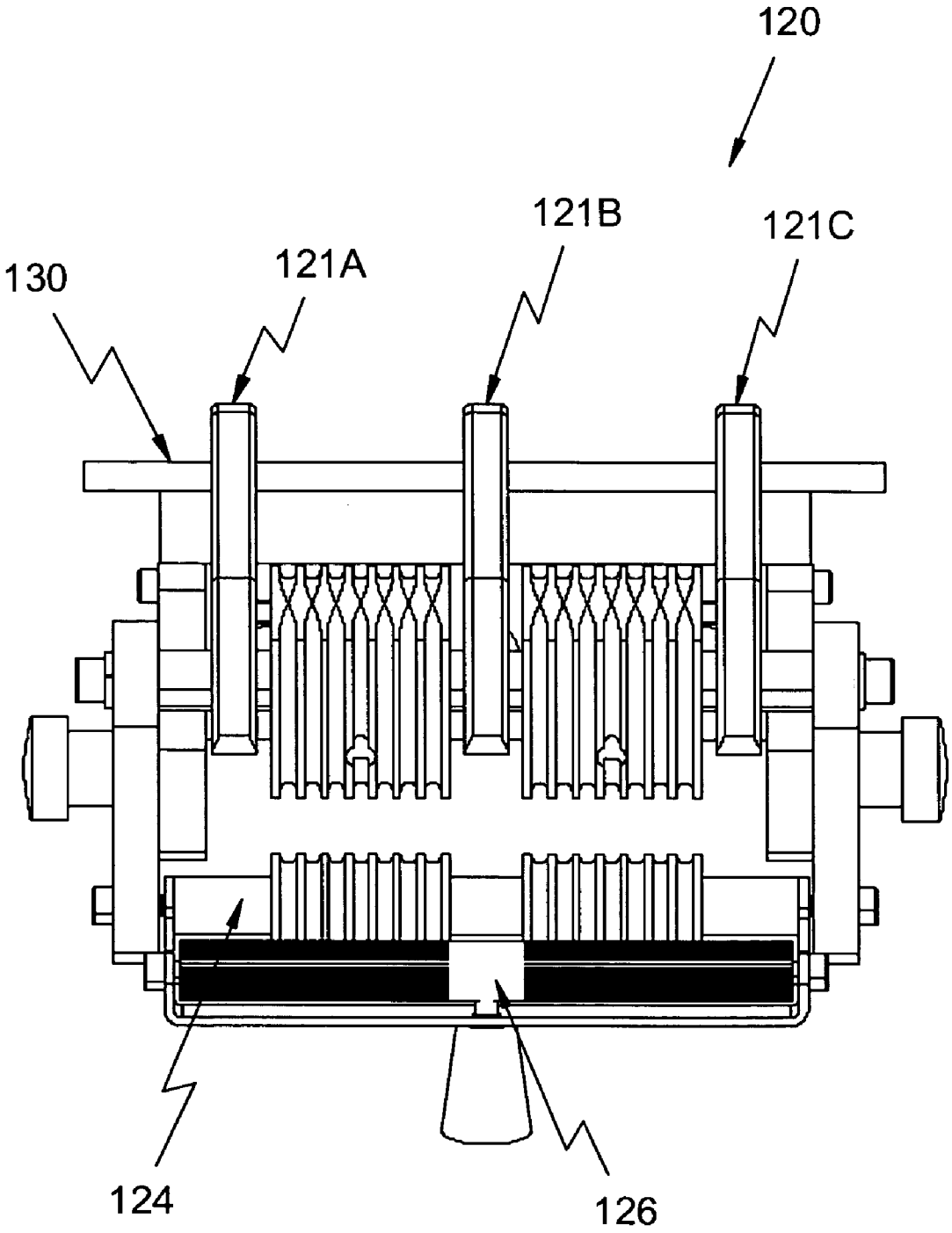
FIG. 15 is a bottom view of the assemblies.
Figure 16:
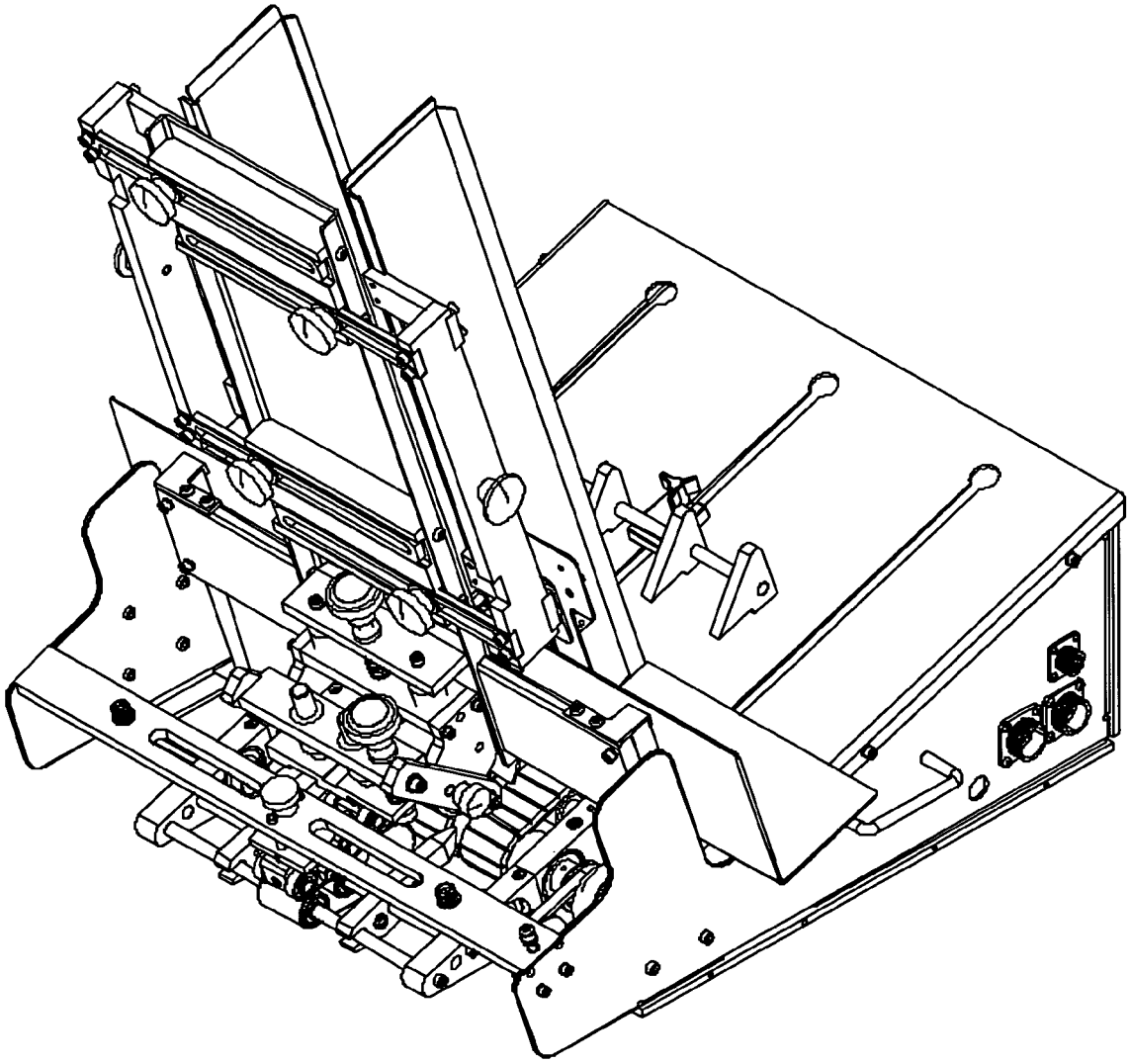
FIG. 16 is a perspective view of the back wedge.
Figure 17:
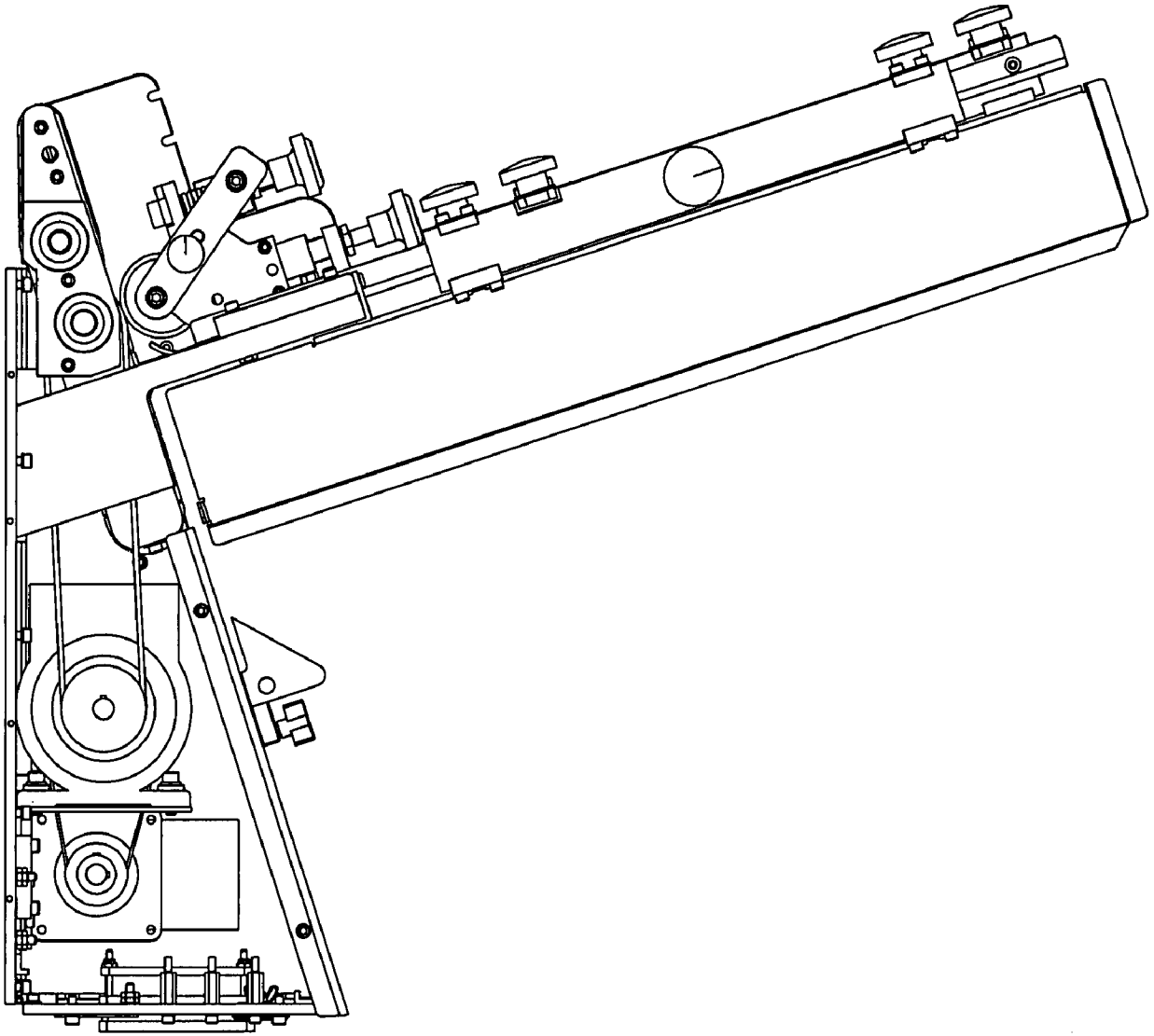
FIG. 17 is a side view of the back wedge.

In FIG. 8. the overall operation of the gate 20 can be seen. The friction feed wheels 56A-B capture a label 70 from the product magazine 16. The label 70 is trapped between the friction wheels 56A-B and the moving belts 14A-D. The belts 14A-D propel the label 70 away from the product magazine 16 for further processing. The friction wheels 56A-B do not rotate but simply act as hold down elements. The deflector wheels 58A-C then act on the label 70 to form grooves or corrugations 72 in the label 70. The friction feed wheels 56 with the belts 14 define a singulation portion and the deflector wheels 58 act with the belts 14 and adjustment plate 50 to define a guide or stabilization portion of the overall gate assembly 20.

Forming a series of corrugations 72 into the label 70 achieves a number of desirable results. The label 70 itself is strengthened. The surface tension between the bottom two labels in the product magazine 16 is reduced, leading to more certain feeding of one label at a time. The corrugations 72 also increase the surface area contact between the label 70 being fed and the belts 14, leading to better feeding. It should be clear from the structure described that the label 70 can be fed with no corrugation if desired or the level of corrugation can be adjusted to a greater or lesser depth.

FIGS. 9-15 show an alternative embodiment of the gate assembly 120. The assembly 120 comprises a wave guide plate 130, wave inserts or guides 121A-C (aligned with belts), shaft meeting plate 122, guide shafts 123, adjustment knob assembly 134, lower mount plate 138, bearings 132, side plates 140, gate side plates 142, main shaft 162, gate wheels 156A and B, advancing roller shaft 124, advancing rollers 125A and B, and an advancing cam shaft 126 and an advancing plate 127.

The inserts 121 have a predetermined configuration which provides a slightly different lead in that that of the prior gate assembly 20 embodiment for easier, greater and more precise adjustability. Gate wheels 156 also have a predetermined configuration. The gate wheels 156 may be stationary (preferred for thin material) or free rotating (preferred for thick material). Gate wheels 156 may be easily swapped for processing different materials.

The descriptions above and the accompanying materials should be interpreted in the illustrative and not the limited sense. While the invention has been disclosed in connection with the preferred embodiment or embodiments thereof, it should be understood that there may be other embodiments which fall within the scope of the invention.

The invention claimed is:

1. A gate assembly for a bottom friction feeder comprising a guide assembly portion, a singulation gate assembly portion including a plurality of deflector wheels, the deflector wheels each having a flat portion; and an adjustment plate having lands that contact the flat portion of the deflector wheels.

2. The gate assembly of claim 1 further including means for adjusting said deflector wheels.

3. The gate assembly of claim 1 wherein said means for adjusting said deflector wheels includes a jack screw, attached to said adjustment plate, for varying the position of contact with said lands on said deflector wheel flats.

4. The gate assembly of claim 1 wherein said deflector wheels are mounted on a common shaft.

5. The gate assembly of claim 1 wherein said deflector wheels are fixed on said common shaft.

6. The gate assembly of claim 5 further including means for adjusting said friction feed wheels relative to said moving belts.

7. The gate assembly of claim 6 wherein said means for adjusting said friction feed wheels includes a support bracket, a jack screw carried by said support bracket, a support plate attached to and movable by said jack screw, and a shaft which carries said friction feed wheels and is attached to said support plate.

8. The gate assembly of claim 6 wherein said friction feed wheels are fixed on said shaft and do not rotate relative to said moving belts.

9. The gate assembly of claim 1 wherein said singulation gate assembly includes a plurality of friction feed wheels and a plurality of moving belts.

* * * * *